US007760172B2

(12) United States Patent
Huh et al.

(10) Patent No.: US 7,760,172 B2
(45) Date of Patent: Jul. 20, 2010

(54) METHOD OF DRIVING A TRANSISTOR, A DRIVING ELEMENT USING THE SAME, AND A DISPLAY PANEL AND A DISPLAY APPARATUS HAVING THE DRIVING ELEMENT

(75) Inventors: Jong-Moo Huh, Hwaseong-si (KR); Joon-Hoo Choi, Seoul (KR); In-Su Joo, Seoul (KR); Beohm-Rock Choi, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1166 days.

(21) Appl. No.: 10/890,505

(22) Filed: Jul. 13, 2004

(65) Prior Publication Data

US 2005/0174311 A1 Aug. 11, 2005

(30) Foreign Application Priority Data

Feb. 9, 2004 (KR) ..... 10-2004-0008392

(51) Int. Cl.
*G09G 3/36* (2006.01)

(52) U.S. Cl. ..... 345/83; 345/87; 345/55; 345/76; 315/169.3

(58) Field of Classification Search ..... 345/30–111; 315/169.3

See application file for complete search history.

(56) References Cited

U.S. PATENT DOCUMENTS 5,945,972 A * 8/1999 Okumura et al. ..... 345/98
6,037,719 A * 3/2000 Yap et al. ..... 315/169.3
6,633,270 B2 * 10/2003 Hashimoto ..... 345/76
2002/0011976 A1 1/2002 Hashimoto
2003/0016191 A1 * 1/2003 Nakamura et al. ..... 345/55
2003/0112213 A1 * 6/2003 Noguchi et al. ..... 345/96
2004/0075634 A1 * 4/2004 Gates ..... 345/99

FOREIGN PATENT DOCUMENTS

CN 1416004 5/2003
WO 2002-97523 A1 12/2002

OTHER PUBLICATIONS

Chinese Office Action dated Feb. 15, 2008 for Korean Patent Appln. No. 2004-8392 corresponding to the above-identified U.S. Appl. No. 10/890,505.

* cited by examiner

*Primary Examiner*—Henry N Tran
*Assistant Examiner*—Christopher E Leiby
(74) *Attorney, Agent, or Firm*—F.Chau & Associates, LLC

(57) ABSTRACT

A method of driving a transistor, a driving element using the same, and a display panel and a display apparatus having the driving element are provided. The method for driving a transistor comprises: receiving a bias voltage at a first electrode of a driving transistor; outputting a first signal having a first polarity from a first electrode of a switching transistor to a capacitor and a control electrode of the driving transistor when a select line is activated for driving an organic display element; and outputting a second signal having a second polarity from the first electrode of the switching transistor to the capacitor and the control electrode of the driving transistor when the select line is activated for dissipating a charge in the driving transistor and for deactivating the organic display element.

7 Claims, 11 Drawing Sheets

300

METHOD OF DRIVING A TRANSISTOR, A DRIVING ELEMENT USING THE SAME, AND A DISPLAY PANEL AND A DISPLAY APPARATUS HAVING THE DRIVING ELEMENT

BACKGROUND OF THE INVENTION

1. Technical Field

The present invention relates to a method of driving a transistor, a driving element using the same, and a display panel and a display apparatus having the driving element.

2. Discussion of the Related Art

Current liquid crystal displays (LCDs) have various characteristics, such as high luminance, high efficiency, uniform luminance, long lifetime, thinness, lightweight, low cost, etc. An LCD include a blacklight to display images. One type of display device that does not include a blacklight is an organic electro luminescent display (OELD).

The OELD displays an image using the electro luminescence of an organic material or polymers. The OELD has various characteristics, such as thinness, low cost, a wide viewing angle, light luminescence, etc.

The OELD also includes an active matrix type OELD and a passive matrix type OELD. The active matrix type OELD includes a switching element disposed in a unit pixel. The passive matrix type OELD does not include a switching element disposed in a unit pixel.

FIG. 1 is a circuit diagram showing a conventional OELD 100. FIG. 2 is a timing diagram showing a data voltage (Vd) applied to a unit pixel of the OELD 100 of FIG. 1. Referring to FIGS. 1 and 2, a unit pixel of the OELD 100 includes a switching element (QS), a driving transistor (QD), a storage capacitor (CST) and an organic electro luminescent element (EL).

The luminescence of the OELD 100 is less than that of a display such as a cathode ray tube (CRT) display. The efficiency, however, of the active matrix type OELD is greater than that of the passive type OELD, therefore the active matrix type OELD is frequently used in the OELD 100.

The mobility of a polysilicon is greater than that of amorphous silicon. The amorphous silicon does not include a positive-type (P-type) transistor, and as the amorphous silicon is fragile it is subject to a bias stress. Therefore, the OELD 100 may include a polysilicon transistor, even though it is more expensive than an amorphous silicon transistor. The OELD 100, however, may also include the amorphous silicon transistor, which includes a driving circuit having a negative-type (N-type) transistor.

Current flowing through the organic electro luminescent element EL of a current driving OELD may be adjusted to display a gray color. In order to control the current flowing through the organic electro luminescent element EL in response to a data signal applied from an exterior to the organic electro luminescent element EL, a thin film transistor (TFT) is serially connected to the organic electro luminescent element EL to apply the data signal to a gate electrode of the driving transistor QD, thereby controlling a channel conductance in response to a gate-source voltage (Vgs) of the driving transistor QD.

When the driving transistor QD includes the P-type transistor, a bias line (VL) serves as a source electrode so that the amount of the gate-source voltage Vgs applied to the driving transistor QD is determined by a data voltage applied to the gate electrode of the driving transistor QD through a data line (DL).

When the driving transistor QD includes the N-type transistor, the organic electro luminescent element EL serves as a source electrode and the voltage applied to a node electrically connected to the driving transistor QD and the organic electro luminescent element EL is unstable. The voltage applied to the node is also dependent on data from a previous frame. In addition, the range of the gate-source voltage Vgs applied to the driving transistor QD is narrower than the range of the data voltage applied to an active region including the driving transistor QD and the organic electro luminescent element EL from an exterior to the driving transistor QD. Therefore, the OELD 100 may include the driving circuit having the P-type transistor.

When the data voltage having the same polarity is applied to the gate electrode of an amorphous silicon TFT for an extended period, the output characteristics of the amorphous silicon TFT deteriorate. In other words, when the data voltage having the same or constant polarity (e.g., a positive polarity) as shown in FIG. 2 is applied to the gate electrode of the driving transistor that controls the output current in response to the gate voltage for an extended period, the characteristics of the amorphous silicon TFT deteriorate.

The amount of the output current also changes in response to the variation of the characteristics of the amorphous silicon TFT, resulting in a malfunction of the driving transistor. The malfunction increases in proportion to an operation time and, therefore, the lifetime of the amorphous silicon TFT is decreased.

In order to control the organic electro luminescent element EL with an output current, a predetermined voltage is applied to the gate electrode of the amorphous silicon TFT. The voltage level applied to the gate electrode may be changed, but a constant voltage having a positive polarity may be applied to the source electrode or the drain electrode.

When the characteristics of the amorphous silicon TFT deteriorate, a charge is injected into an interface between a gate insulator and the gate electrode and the charge is trapped between the gate insulator and the gate electrode and a defect is formed on an amorphous silicon layer, thereby changing the threshold voltage (Vth) and the output current. Accordingly, the injected charge and the resulting defect increase in proportion to the operation time of the amorphous silicon TFT. Thus, there is a need for reducing the effects of an injected charge in an amorphous silicon TFT.

SUMMARY OF THE INVENTION

In one embodiment of the present invention, a method for driving a transistor, comprises: receiving a bias voltage at a first electrode of a driving transistor; outputting a first signal having a first polarity from a first electrode of a switching transistor to a capacitor and a control electrode of the driving transistor when a select line is activated for driving an organic display element; and outputting a second signal having a second polarity from the first electrode of the switching transistor to the capacitor and the control electrode of the driving transistor when the select line is activated for dissipating a charge in the driving transistor and for deactivating the organic display element.

The second polarity is opposite the first polarity. The first signal is output during an image display period. The second signal is output during a non-image display period in one of a single frame after the first signal is output and after multiple image display frames. The bias voltage is received at a first electrode of the driving transistor from a bias line. The first and second signals are received at a second electrode of the switching transistor from a data line. The switching transistor is one of an amorphous silicon thin film transistor (TFT) and a polysilicon TFT and the driving transistor is one of an amorphous silicon TFT and a polysilicon TFT. The driving transistor controls the bias voltage in response to the first signal for illuminating the organic display element. The organic display element is in a liquid crystal display (LCD) device.

In another embodiment of the present invention, a driver for driving an organic display unit, comprises: a first switching transistor for selectively applying a first signal having a first polarity to a first capacitor and a second gate electrode of a first driving transistor when a select line is activated and for applying a second signal having a second polarity to the first capacitor and the second gate electrode of the first driving transistor when the select line is activated; and a first driving transistor for driving an organic display unit in response to the first signal, and for dissipating a first charge in the first driving transistor and for deactivating the organic display unit in response to the second signal.

The first polarity is positive and the second polarity is negative. The first switching transistor comprises a first electrode, a second electrode, and a first gate electrode, wherein the first gate electrode is connected to the select line, the first electrode is connected to a first data line, and the second electrode is connected to the first driving transistor and the first capacitor. The first driving transistor comprises a third electrode, a fourth electrode, and a second gate electrode, wherein the second gate electrode is connected to the first switching transistor and the first capacitor, the third electrode is connected to a bias voltage line, and the fourth electrode is connected to the organic display unit.

The first capacitor is connected to the second electrode of the first switching transistor and the second gate electrode of the first driving transistor, and a bias voltage line. The first and second signals are received from a first data line. The first signal is output during an image display period. The second signal is output during a non-image display period in one of a single frame after the first signal is output and after multiple image display frames. The switching transistor is one of an amorphous silicon thin film transistor (TFT) and a polysilicon TFT and the driving transistor is one of an amorphous silicon TFT and a polysilicon TFT. The driving transistor controls a bias voltage in response to the first signal for driving the organic display unit. The organic display unit is an organic electro luminescent element. The organic display unit is in a liquid crystal display (LCD) device.

The driver further comprises: a second switching transistor for applying a third signal having a third polarity to a second capacitor and a fourth gate electrode of a second driving transistor when the select line is activated and for applying a fourth signal having a fourth polarity to the second capacitor and the fourth gate electrode of the second driving transistor when the select line is activated; and a second driving transistor for driving the organic display unit in response to the third signal, and for dissipating a second charge in the second driving transistor and for deactivating the organic display unit in response to the fourth signal.

The third polarity is positive and the fourth polarity is negative. The third and fourth signals are received from a second data line. The second capacitor is connected to a fourth electrode of the electrode switching transistor and a fourth gate electrode of the second driving transistor, and a bias voltage line.

In yet another embodiment of the present invention, a liquid crystal display (LCD) apparatus, comprises: an LCD display, comprising: a plurality of first data lines for receiving a first data signal; a plurality of first bias lines for receiving a first bias voltage; a plurality of first scan lines for receiving a first scan signal; and a first driver for driving an organic display unit, comprising; a first switching transistor for applying a first signal having a first polarity to a first capacitor and a second gate electrode of a first driving transistor when one of the plurality of scan lines is activated and for applying a second signal having a second polarity to the first capacitor and the second gate electrode of the first driving transistor when one of the plurality of scan lines is activated; a first driving transistor for driving the organic display unit in response to the first signal, and for dissipating a first charge in the first driving transistor and for deactivating the organic display unit in response to the second signal.

The second polarity is opposite the first polarity. The plurality of first data lines are extended in a vertical direction. The plurality of first bias lines are extended in a vertical direction. The plurality of first scan lines are extended in a horizontal direction. The first and second signals are received at the first switching transistor from the plurality of first data lines. The first driving transistor controls the first bias voltage in response to the first signal for illuminating the organic display unit. The first signal is output during an image display period. The second signal is output during a non-image display period in one of a single frame after the first signal is output and after multiple image display frames.

The LCD apparatus further comprises: a timing controller for outputting an image signal and a plurality of timing signals; a data driver for receiving the image signal and outputting the first data signal in response to one of the plurality of timing signals; and a scan driver for receiving one of the plurality of timing signals and outputting the first scan signal in response to one of the plurality of timing signals and a power supply for receiving one of the plurality of timing signals and supplying a plurality of power signals.

The LCD panel further comprises: a plurality of second data lines for receiving a second data signal; a plurality of second bias lines for receiving a second bias voltage; a plurality of second scan lines for receiving a second scan signal; a second driver for driving the organic display unit, comprising; a second switching transistor for applying a third signal having a third polarity to a second capacitor and a fourth gate electrode of a second driving transistor when the select line is activated and for applying a fourth signal having a fourth polarity to the second capacitor and the fourth gate electrode of the second driving transistor when the select line is activated; and a second driving transistor for driving the organic display unit in response to the third signal, and for dissipating a second charge in the second driving transistor and for deactivating the organic display unit in response to the fourth signal. The fourth polarity is opposite the third polarity. The third and fourth signals are received at the second switching transistor from the plurality of second data lines.

The LCD apparatus further comprises: a timing controller for outputting an image signal and a plurality of timing signals; a data driver for receiving the image signal and outputting the second data signal in response to one of the plurality of timing signals; and a scan driver for receiving one of the plurality of timing signals and outputting the second scan signal in response to one of the plurality of timing signals.

The foregoing features are of representative embodiments and are presented to assist in understanding the invention. It should be understood that they are not intended to be considered limitations on the invention as defined by the claims, or limitations on equivalents to the claims. Therefore, this summary of features should not be considered dispositive in determining equivalents. Additional features of the invention will become apparent in the following description, from the drawings and from the claims.

BRIEF DESCRIPTION OF THE DRAWINGS

The above features of the present invention will become more apparent to those of ordinary skill in the art by describing in detail exemplary embodiments thereof with reference to the attached drawings, in which.

DETAILED DESCRIPTION OF EXEMPLARY EMBODIMENTS

Figure 1:
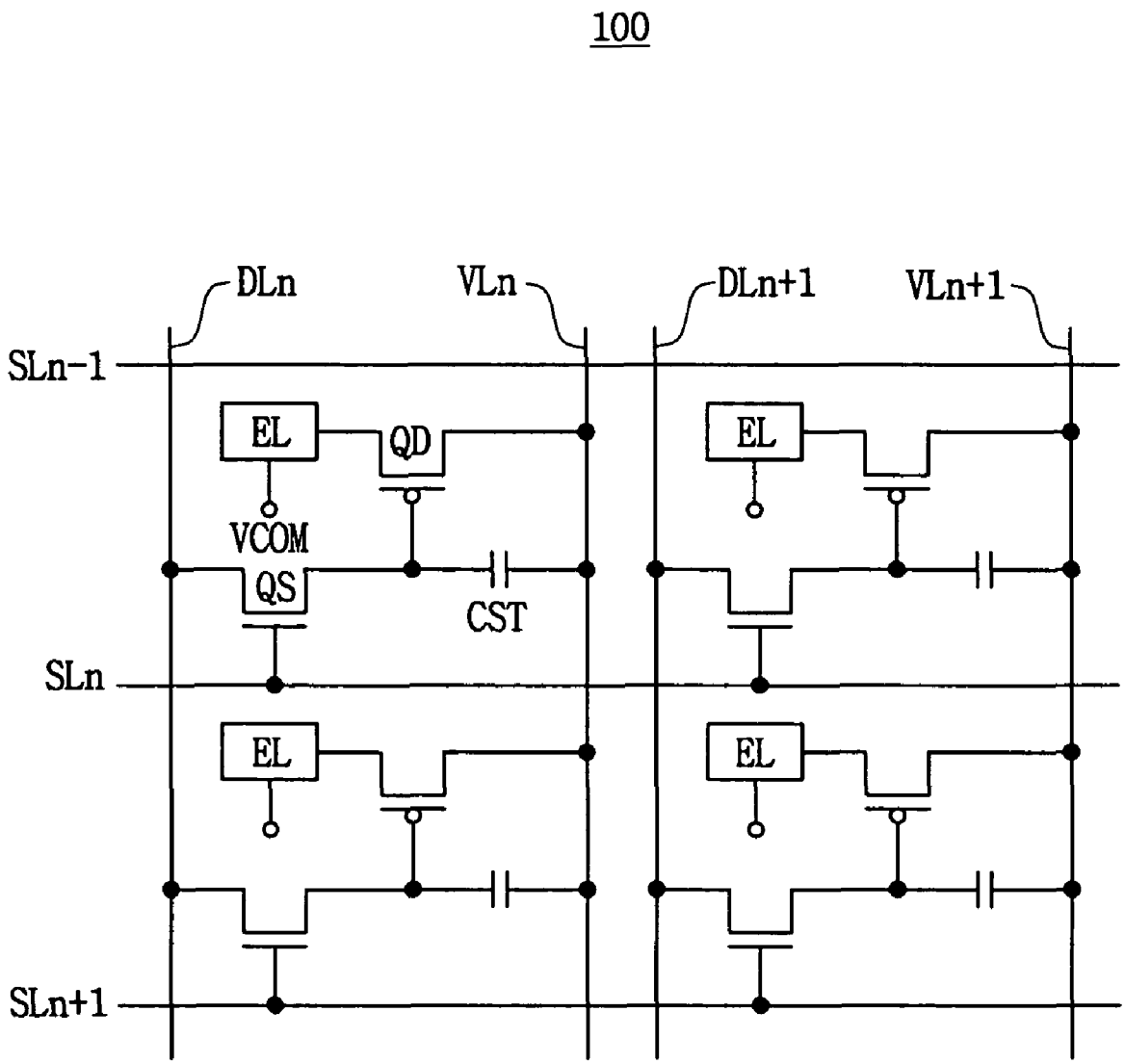
FIG. 1 (PRIOR ART)
FIG. 1 is a circuit diagram showing a conventional organic electro luminescent display (OELD)
Figure 2:
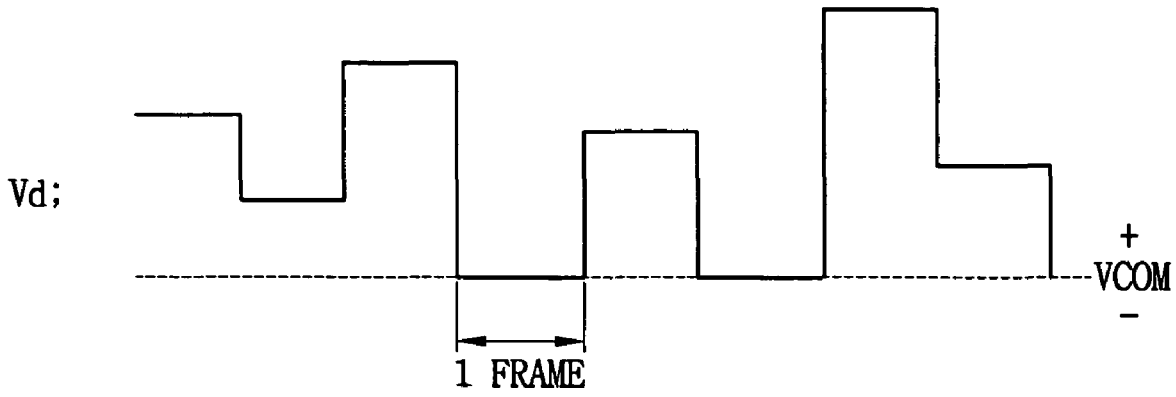
FIG. 2 (PRIOR ART)
FIG. 2 is a timing diagram showing a data voltage applied to a unit pixel of the conventional OELD of FIG. 1.
Figure 3:
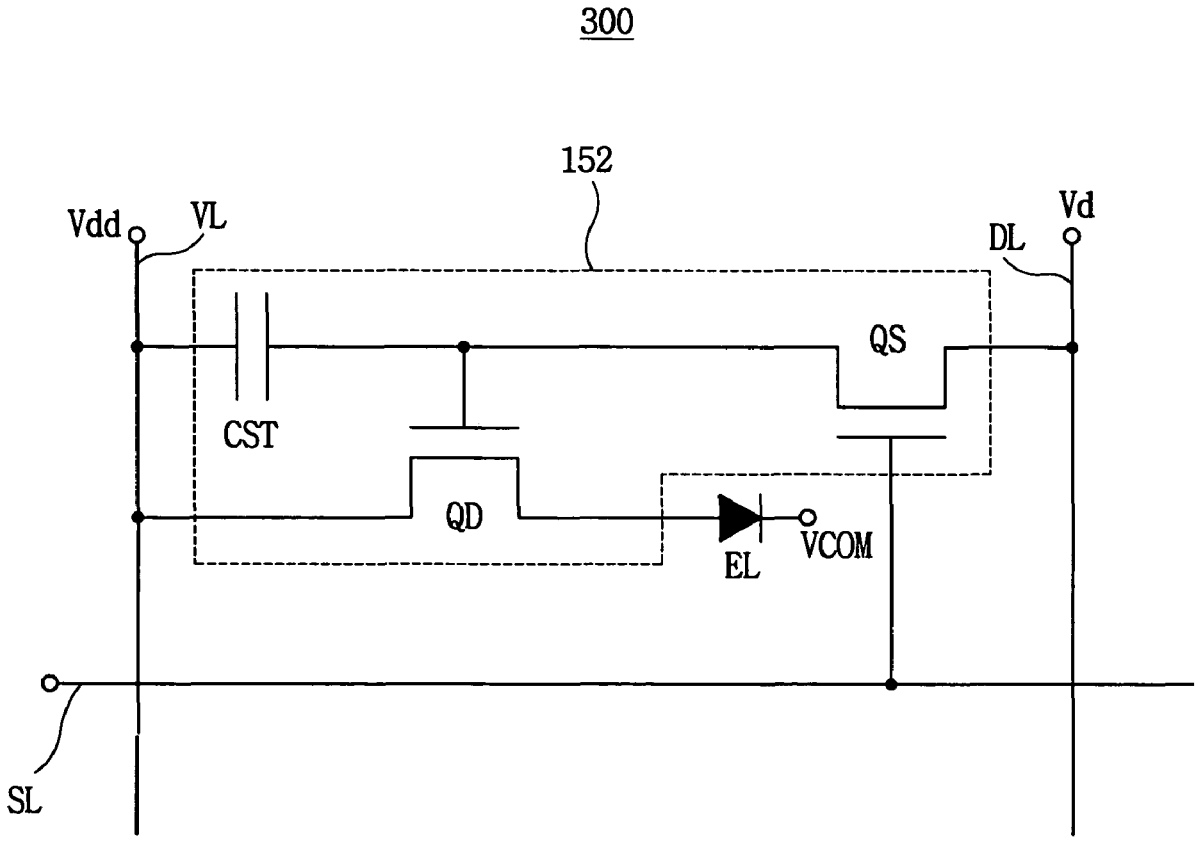
FIG. 3 is a circuit diagram showing a unit pixel of an OELD according to an exemplary embodiment of the present invention.

FIG. 3 is a circuit diagram showing a unit pixel 300 of an organic electro luminescent display (OELD) according to an exemplary embodiment of the present invention. Referring to FIG. 3, the unit pixel 300 of the OELD includes a plurality of data lines (DL), a plurality of bias lines (VL), a plurality of scan lines (SL), a switching transistor (QS), a storage capacitor (CST), a driving transistor (QD) and an organic electro luminescent element (EL). The switching transistor QS, the storage capacitor CST and the driving transistor QD form an organic electro luminescent driver 152 that controls current flow through the organic electro luminescent element EL.

The data lines DL are extended in a vertical direction, and a data voltage (Vd) is applied from an exterior of the OELD to the switching transistor QS. The bias lines VL are also extended in the vertical direction and a bias voltage (Vdd) is applied from the exterior of the OELD to the storage capacitor CST and the driving transistor QD. The scan lines SL are extended in a horizontal direction, and a scan signal is applied from an exterior of the OELD to the switching transistor QS.

When the scan lines SL, which are electrically connected to a first gate electrode of the switching transistor QS are activated, the switching transistor QS outputs a data signal applied from the data line DL to the storage capacitor CST and the driving transistor QD through a first source electrode of the switching transistor OS. The data lines DL are electrically connected to a first drain electrode of the switching transistor QS. The data signal may include a positive polarity or a negative polarity. The data signal includes the positive polarity during an image display period, and includes the negative polarity for improving the characteristics of the driving transistor QD. Therefore, the data signal output from the first source electrode of the switching transistor QS to be applied to a second gate electrode of the driving transistor QD has a predetermined polarity (e.g., a positive polarity) during the image display period, whereas the data signal has the reverse polarity during a non-display period.

The image is displayed using the organic electro luminescent element EL during the image display period, and the organic electro luminescent element EL is not operated for the image during the non-display period. The display period corresponds to an initial time of a frame, and the non-display period is a remaining time of the frame.

A first end portion of the storage capacitor CST is electrically connected to the first source electrode of the switching transistor QS and the second gate electrode of the driving transistor QD. A second end portion of the storage capacitor CST is electrically connected to one of the bias lines VL. When the switching transistor QS is turned off, the data signal is not applied to the second gate electrode of the driving transistor QD. In this case, the storage capacitor CST applies a stored charge to the second gate electrode of the driving transistor QD.

When the data signal is applied to the first source electrode of the switching transistor QS through the second gate electrode of the driving transistor QD, the driving transistor QD controls the bias voltage that is applied to a second drain electrode of the driving transistor QD in response to the data signal to supply a current that illuminates the organic electro luminescent element EL.

When the data signal having the positive polarity is applied to a second source electrode of the driving transistor QD for displaying the image, the driving transistor is turned on to apply the current in response to the bias voltage Vdd that is adjusted in response to the data signal to the organic electro luminescent element EL through the second source electrode of the driving transistor QD.

When the data signal having the negative polarity is applied to the second source electrode of the driving transistor QD for improving the characteristics of the driving transistor QD, the driving transistor QD dissipates a charge that is concentrated on a portion between its second gate electrode and a gate insulating layer, thereby preventing the trapping of the concentrated charge and a defect that may be formed on the amorphous silicon layer. Therefore, the characteristics of the driving transistor QD are improved.

It is to be understood that the switching transistor QS and the driving transistor QD may include polysilicon negative-type (N-type) transistors or positive-type (P-type) transistors. It is to be understood that the transistor for use with the present invention may be an amorphous silicon thin film transistor (TFT) or a polysilicon TFT.

Figure 4:
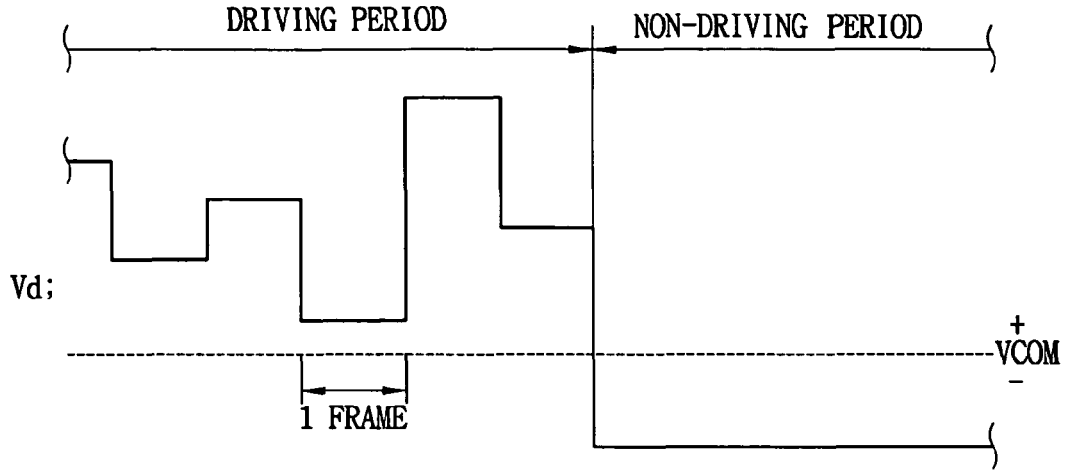
FIG. 4 is a timing diagram showing a data voltage applied to the unit pixel of the OELD shown in FIG. 3.

FIG. 4 is a timing diagram showing a data voltage (Vd) applied to the unit pixel 300 of the OELD shown in FIG. 3. It is to be understood that a gate voltage having a positive polarity or a negative polarity is applied to the OELD when an image is displayed and the gate voltage having a reverse polarity is applied to the OELD when the image is not displayed.

Referring to FIG. 4, the data voltage Vd has a positive polarity during an image display period (e.g., a driving period). More specifically, the data voltage Vd has the positive polarity when compared to a common voltage (VCOM) that is applied to a common electrode of the OELD. The data voltage Vd has a reverse polarity, which may be a negative polarity, during a non-display period (e.g., a non-driving period). More particularly, the data voltage Vd has the reverse polarity when compared to the common voltage VCOM. The magnitude of the data voltage Vd having the negative polarity is similar to that of the data voltage Vd having the positive polarity. For example, when the maximum value of the data voltage Vd having the positive polarity is about +10V, the minimum value of the data voltage Vd having the negative polarity is about −10V.

When the common voltage VCOM is applied to the second gate electrode of the driving transistor OD when the organic electro luminescent element EL is operating, the organic electro luminescent element EL displays a black color corresponding to the minimum value of the data voltage Vd. A light is also illuminated by the organic electro luminescent element EL in response to the amount of the data voltage Vd.

It is to be understood that the amount of light illuminated by the organic electro luminescent element EL is controlled using a current that is changed in response to the amount of voltage applied to the first or second gate electrode of the driving transistor QD thereby preventing the deterioration of the color reproducibility of a display such as an OELD.

When the data voltage Vd having a constant polarity (e.g., a constant positive polarity) is applied to the driving transistor QD to operate the organic electro luminescent element EL, the characteristics of the driving transistor QD change and the driving transistor's QD characteristics deteriorate. However, when the data voltage Vd having the reverse polarity (e.g., a negative polarity) is applied to the driving transistor OD during the non-display period, the characteristics of the driving transistor QD improve.

Figure 5:
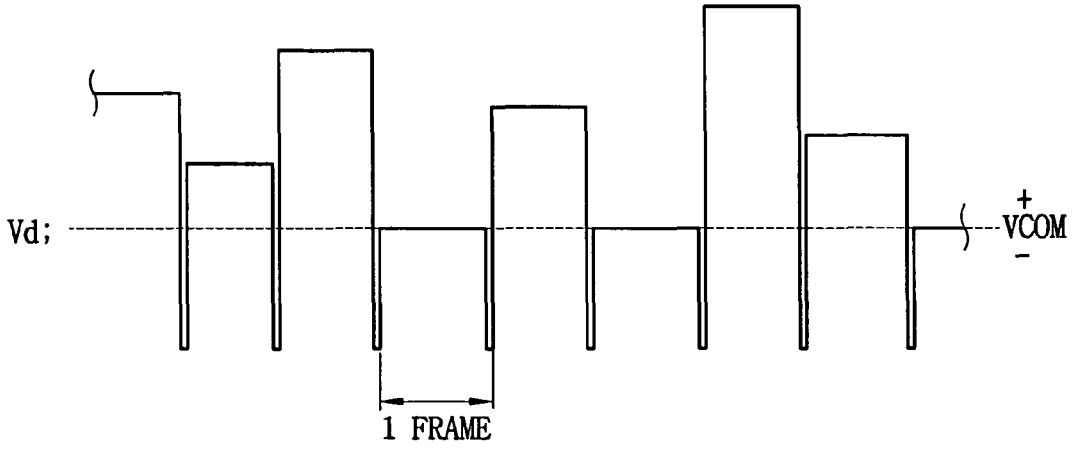
FIG. 5 is a timing diagram showing another data voltage applied to the unit pixel of the OELD shown in FIG. 3.

FIG. 5 is a timing diagram showing another data voltage Vd applied to the unit pixel 300 of the OELD shown in FIG. 3. Referring to FIG. 5, the data voltage Vd has a predetermined polarity during an initial time of a frame. More particularly, the data voltage Vd has a positive polarity when compared to a common voltage (VCOM) during the initial time of the frame.

The data voltage Vd has a reverse polarity, which is a negative polarity, during a remaining time of the frame. The magnitude of the data voltage Vd having the negative polarity is similar to that of the data voltage Vd having the positive polarity. For example, when the maximum value of the data voltage Vd having the positive polarity is about +10V, the minimum value of the data voltage Vd having the negative polarity is about −10V. As shown in FIG. 5, the values of negative polarity are similar to one another.

After the data voltage Vd having the negative polarity is applied to the driving transistor QD during the remaining time of the frame to turn off the driving transistor QD, the data voltage Vd having the positive polarity is applied to the driving transistor QD, thereby improving the characteristics of the driving transistor QD.

Figure 6:
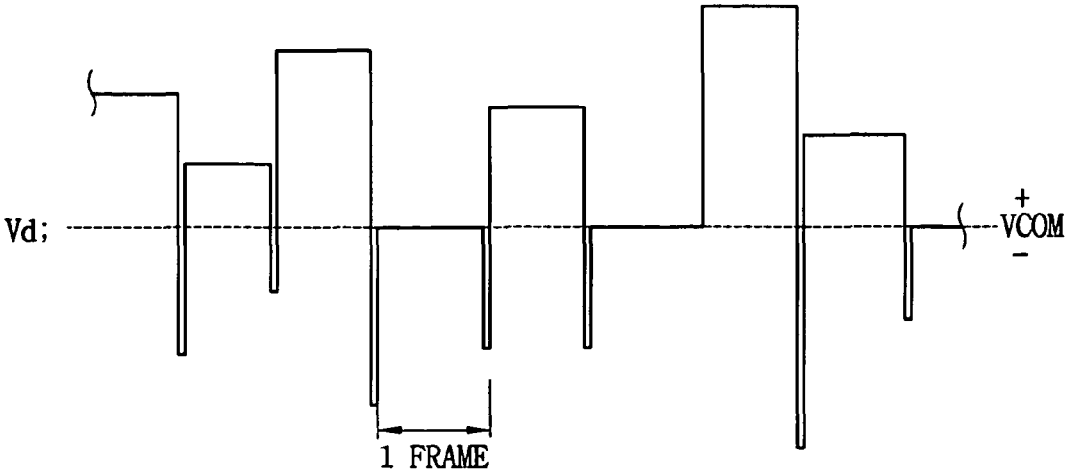
FIG. 6 is a timing diagram showing yet another data voltage applied to the unit pixel of the OELD shown in FIG. 3.

FIG. 6 is a timing diagram showing yet another data voltage (Vd) applied to the unit pixel 300 of the OELD shown in FIG. 3. Referring to FIG. 6, the data voltage Vd has a predetermined polarity during an initial time of a frame. More particularly, the data voltage Vd has a positive polarity when compared to a common voltage (VCOM) during the initial time of the frame.

The data voltage Vd has a reverse polarity, which is a negative polarity, during a remaining time of the frame. The magnitude of the data voltage Vd having the negative polarity is similar to that of the data voltage Vd having the positive polarity. For example, when the maximum value of the data voltage Vd having the positive polarity is about +5V, the minimum value of the data voltage Vd having the negative polarity is about −5V. In addition, when the maximum value of the data voltage Vd having the positive polarity is about +10V, the minimum value of the data voltage Vd having the negative polarity is about −10V.

After the data voltage Vd having the negative polarity is applied to the driving transistor QD during the remaining time of the frame to turn off the driving transistor QD, the data voltage Vd having the positive polarity is applied to the driving transistor QD, thereby improving the characteristics of the driving transistor QD.

Figure 7:
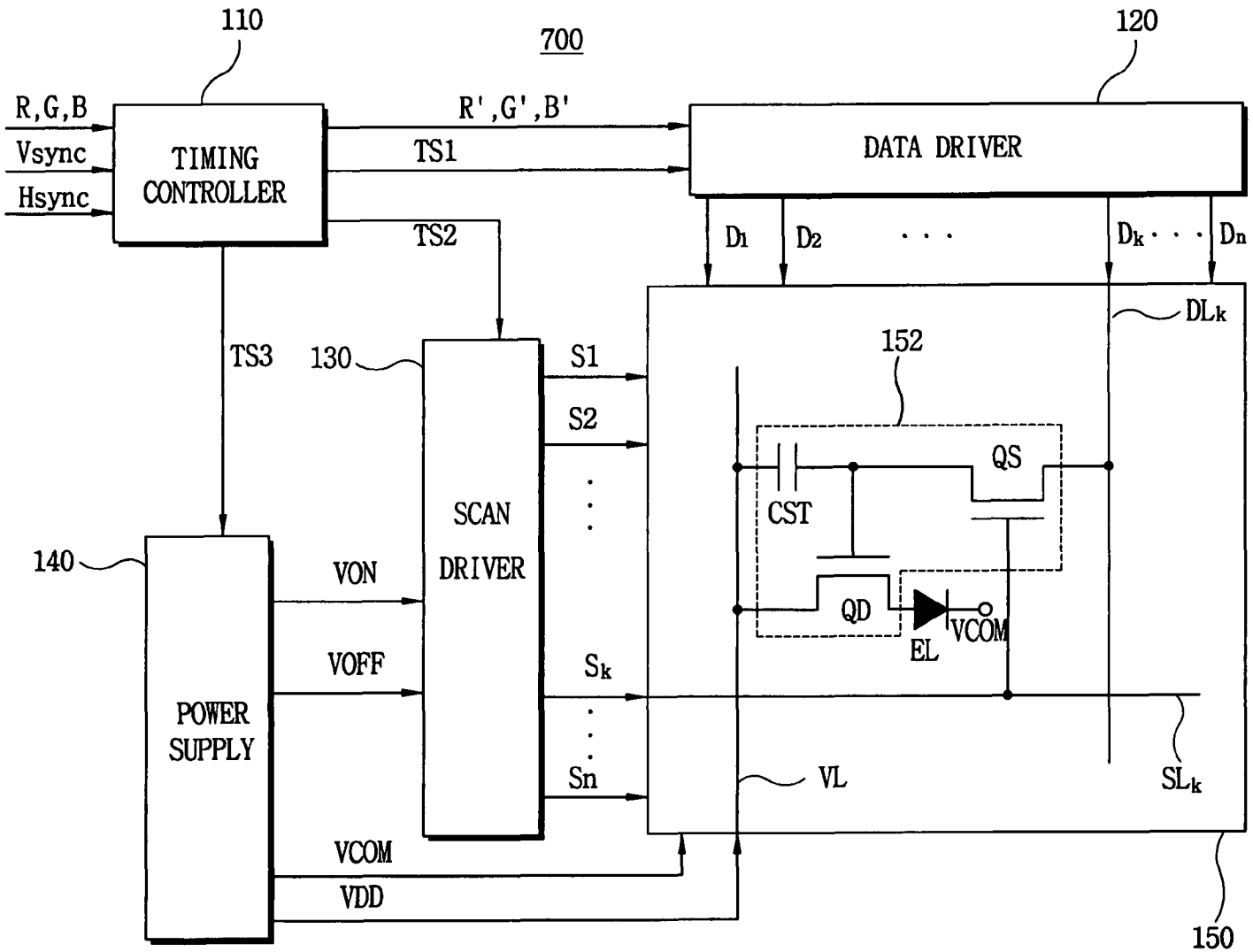
FIG. 7 is a schematic diagram showing an OELD according to another exemplary embodiment of the present invention.

FIG. 7 is a schematic diagram showing an OELD 700 according to another exemplary embodiment of the present invention. Referring to FIG. 7, the OELD 700 includes a timing controller 110, a data driver 120, a scan driver 130, a power supply 140 and an organic electro luminescent display (OELD) panel 150. The data driver 120 outputs a data signal in response to an image signal. The scan driver 130 outputs a scan signal in response to a timing signal. The power supply 140 supplies a plurality of power voltages. The OELD panel 150 controls current in response to the scan signal and the data signal to display an image using an organic electro luminescent element (EL).

As shown in FIG. 7, an external graphic controller (not shown) applies first image signals (R, G, B) and control signals (Vsync, Hsync), which control the output of the first image signals R, G, B from the timing controller 110, which generates a first timing signal and a second timing signal (TS1 and TS2) and outputs the first timing signal (TS1) and second image signals (R', G', B') to the data driver 120. The timing controller 110 also outputs a third timing signal (TS3) to the power supply 140.

The data driver 120 receives the second image signals R', G', B' and the first timing signal TS1 to output data signals (D1, D2 . . . Dk . . . Dn) to the OELD panel 150. The data signals D1, D2 . . . Dk . . . Dn correspond to gray-scales. The data signals D1, D2 . . . Dk . . . Dn also have a positive polarity for displaying an image and a negative polarity for improving the characteristics of a driving transistor QD. One of the data signals D1, D2 . . . Dk . . . Dn output from a first source electrode of a switching transistor QS of the OELD panel 150 is applied to a second gate electrode of the driving transistor QD. The one data signal includes a predetermined polarity during an image display period and a reverse polarity during a non-display period.

As shown in FIG. 7, the scan driver 130 receives the second timing signal TS2 to output scan signals (S1, S2 . . . Sk . . . Sn) to the OELD panel 150. The power supply 140 receives a third timing signal TS3 to output a gate on/off and/or voltage (VON/VOFF) signal to the scan driver 130. The power supply 140 also applies a common voltage (VCOM) and a bias voltage (VDD) to the OELD panel 150.

The OELD panel 150 includes a plurality of data lines (DL), a plurality of bias lines (VL), a plurality of scan lines (SL), an organic electro luminescent driver 152 and the organic electro luminescent element EL. The organic electro luminescent driver 152 is formed in a region defined by the data lines DL and the scan lines SL, which are located adjacent to each other, and includes an amorphous silicon thin film transistor (a-Si TFT). The organic electro luminescent element EL is electrically connected to the organic electro luminescent driver 152.

The data lines DL are extended in a vertical direction, and arranged in a horizontal direction. The data driver 120 applies the data signals D1, D2 . . . Dk . . . Dn to the organic electro luminescent driver 152 through the data lines DL. The bias lines VL are extended in the vertical direction, and arranged in the horizontal direction. The power supply 140 applies the bias voltage VDD to the organic electro luminescent driver 152 through the bias lines VL. The scan lines SL are extended in the horizontal direction, and arranged in the vertical direction. The scan driver 130 applies the scan signals S1, S2 . . . Sk . . . Sn to the organic electro luminescent driver 152 through the scan lines SL.

In an alternative embodiment, the OELD 700 may include a common voltage line that applies the common voltage VCOM directly to the organic electro luminescent element EL. In this alternative embodiment, the power supply 140 applies the common voltage VCOM to the OELD panel 150 through the common voltage line.

The organic electro luminescent driver 152 includes a switching transistor (QS), a driving transistor (QD) and a storage capacitor (CST). When current is controlled using the driving and the switching transistors QD and QS, the transistors QD and QS may be formed in one layer or two layers stacked on top of each other. When the organic electro luminescent driver 152 includes the two transistors QD and QS, a voltage applied to each of the transistors QD and QS is decreased in order to improve the characteristics of the transistors QD and QS, thereby increasing the lifetime of the transistors QD and QS.

Figure 8:
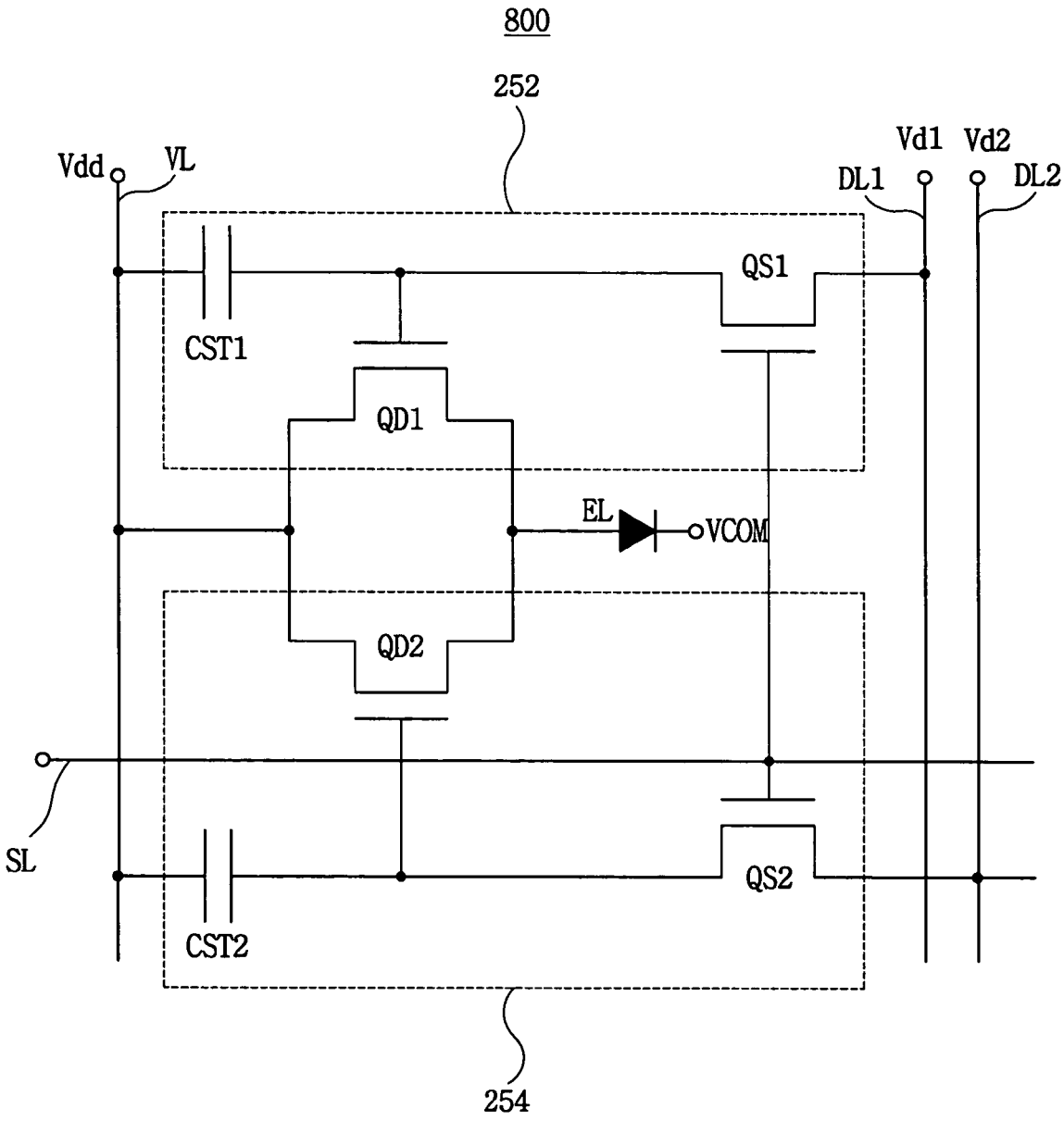
FIG. 8 is a circuit diagram showing a unit pixel of an OELD according to yet another exemplary embodiment of the present invention.

FIG. 8 is a circuit diagram showing a unit pixel 800 of an OELD according to yet another exemplary embodiment of the present invention. Referring to FIG. 8, the unit pixel 800 includes a plurality of first data lines (DL1), a plurality of second data lines (DL2), a plurality of bias lines (VL), a plurality of scan lines (SL), a first organic electro luminescent driver 252, a second organic electro luminescent driver 254 and an organic electro luminescent element (EL).

The first data lines DL1 are extended in a vertical direction. A first data signal (Vd1) provided from an exterior is applied to the first organic electro luminescent driver 252 through one of the first data lines DL1. The second data lines DL2 are extended in the vertical direction. A second data signal (Vd2) provided from an exterior is applied to the second organic electro luminescent driver 254 through one of the second data lines DL2.

The bias lines VL are extended in the vertical direction. A bias voltage (Vdd) provided from an exterior is applied to the first and second organic electro luminescent drivers 252 and 254. The scan lines SL are extended in a horizontal direction. A scan signal provided from an exterior is applied to the first and second organic electro luminescent drivers 252 and 254.

The first organic electro luminescent driver 252 includes a first switching transistor (QS1), a first storage capacitor (CST1) and a first driving transistor (QD1). The first organic electro luminescent driver 252 controls current that flows through the organic electro luminescent element EL.

When one of the scan lines (SL), which is electrically connected to a first gate electrode of the first switching transistor (QS1) is activated, the first switching transistor QS1 outputs a first data signal (Vd1) that is applied from the one of the first data lines DL1 to the first storage capacitor CST1 and the first driving transistor QD1 through a first source electrode. The first data line DL1 is electrically connected to the first drain electrode of the first switching transistor QS1.

The first storage capacitor CST1 includes a first end portion that is electrically connected to the first source electrode of the first switching transistor QS1 and a second gate electrode of the first driving transistor QD1 and a second end portion that is electrically connected to one of the bias lines VL. The first storage capacitor CST1 applies a stored charge to the second gate electrode of the first driving transistor QD1 when the first switching transistor QS1 is turned off.

Figure 9A:
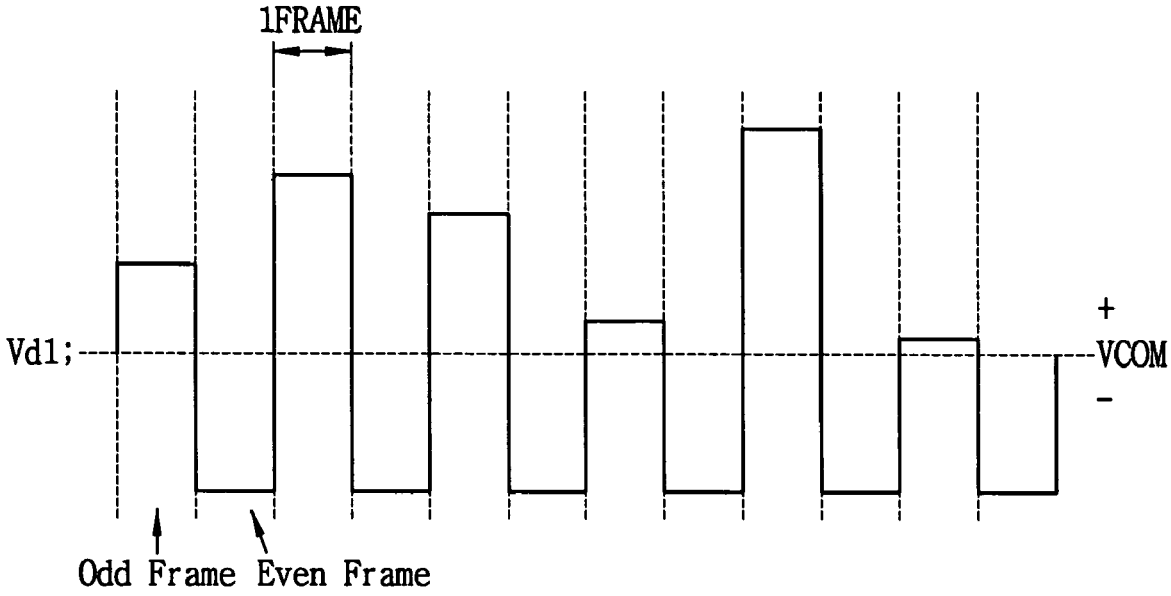
FIGS. 9A and 9B are timing diagrams showing a first data signal and a second data signal applied to the OELD shown in FIG. 8.
Figure 9B:
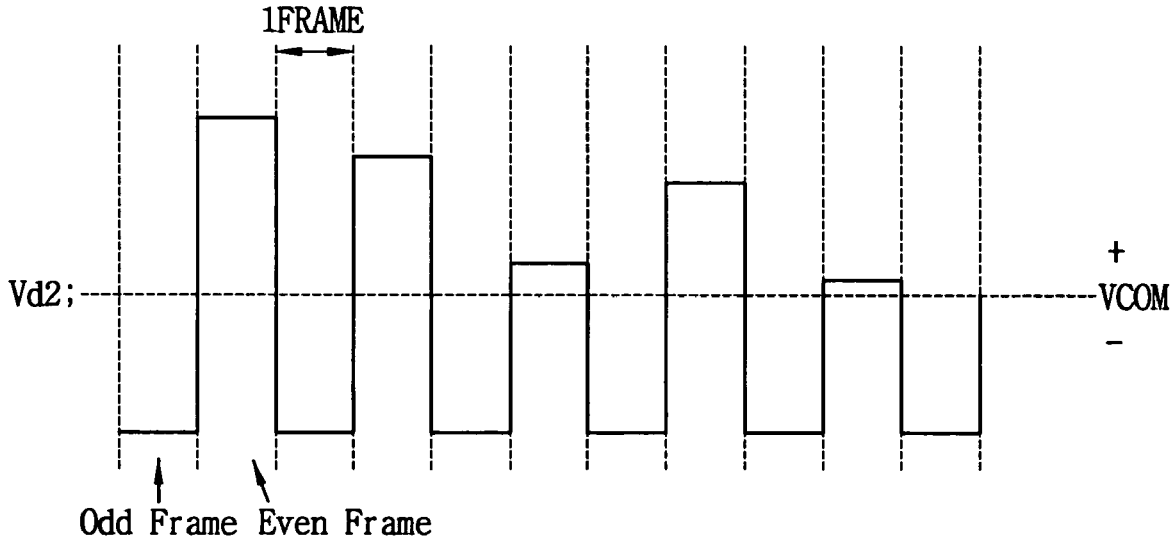

FIGS. 9A and 9B are timing diagrams showing a first data signal Vd1 and a second data signal Vd2 applied to the OELD shown in FIG. 8. It is to be understood that a gate voltage having a positive polarity and a gate voltage having a negative polarity are successively applied to the OELD of FIG. 8.

When the first data signal Vd1 (shown in FIG. 9A) is applied from the first source electrode of the first switching transistor QS1 to the second gate electrode of the first driving transistor QD1, the first driving transistor QD1 controls the bias voltage that is applied to a second drain electrode in response to the first data signal Vd1, thereby applying a current to the organic electro luminescent element EL that illuminates the organic electro luminescent element EL. Referring again to FIG. 9A, the first data signal Vd1 having a predetermined polarity is applied to the second gate electrode of the first driving transistor QD1 for displaying an image during an odd frame. Therefore, the first driving transistor QD1 is turned on to apply the current corresponding to the bias voltage that is controlled in response to the first data signal Vd1.

The first data signal Vd1 having a reverse polarity is applied to the second gate electrode of the first driving transistor QD1 during an even frame. The first driving transistor QD1 is turned off to dissipate a charge concentrated on a portion disposed between the second gate electrode and a gate insulating layer, thereby preventing the trapping of the concentrated charge and the defect formed on an amorphous silicon layer of the first switching transistor QS1 and the first driving transistor QD1. Therefore, the characteristics of the first switching transistor QS1 and the first driving transistor QD1 are improved.

The second organic electro luminescent driver 254 of FIG. 8 includes a second switching transistor (QS2), a second storage capacitor (CST2) and a second driving transistor (QD2). The second organic electro luminescent driver 254 controls current that flows through the organic electro luminescent element EL.

When one of the scan lines SL, which are electrically connected to a third gate electrode of the third switching transistor QS2, is activated the second switching transistor QS2 outputs a second data signal (Vd2) that is applied from the one of the second data lines DL2 to the second storage capacitor CST2 and the second driving transistor QD2 through a third source electrode. The second data line DL2 is electrically connected to the third drain electrode of the second switching transistor QS2.

The second storage capacitor CST2 includes a third end portion that is electrically connected to the third source electrode of the second switching transistor QS2 and a fourth gate electrode of the second driving transistor QD2 and a fourth end lo portion that is electrically connected to one of the bias lines VL. The second storage capacitor CST2 applies a stored charge to the fourth gate electrode of the second driving transistor QD2 when the second switching transistor QS2 is turned off.

When the second data signal Vd2 (shown in FIG. 9B) is applied from the third source electrode of the second switching transistor QS2 to the fourth gate electrode of the second driving transistor QD2, the second driving transistor QD2 controls the bias voltage applied to a fourth drain electrode in response to the second data signal Vd2, thereby applying a current to the organic electro luminescent element EL that illuminates the organic electro luminescent element EL.

Referring to FIG. 9B, the second data signal Vd2 having a reverse polarity is applied to the fourth gate electrode of the second driving transistor QD2 during an even frame. The second driving transistor QD2 is turned off to dissipate a charge concentrated on a portion disposed between the fourth gate electrode and a gate insulating layer, thereby preventing the trapping of the concentrated charge and the defect formed on an amorphous silicon layer of the second switching transistor QS2 and the second driving transistor QD2. Thus, the characteristics of the second switching transistor QS2 and the second driving transistor QD2 are improved.

The second data signal Vd2 having a predetermined polarity is applied to the fourth gate electrode of the second driving transistor QD2 for displaying an image during an odd frame. Therefore, the second driving transistor QD2 is turned on to apply the current corresponding to the bias voltage that is controlled in response to the second data signal Vd2.

The amount of the reverse voltage of the first data Vd1 signal may be similar to that of the second data signal Vd2. Alternatively, the amount of the reverse voltage of the first and second data signals Vd1 and Vd2 may be dependent on the amount of the voltage having the positive polarity.

Figure 10A:
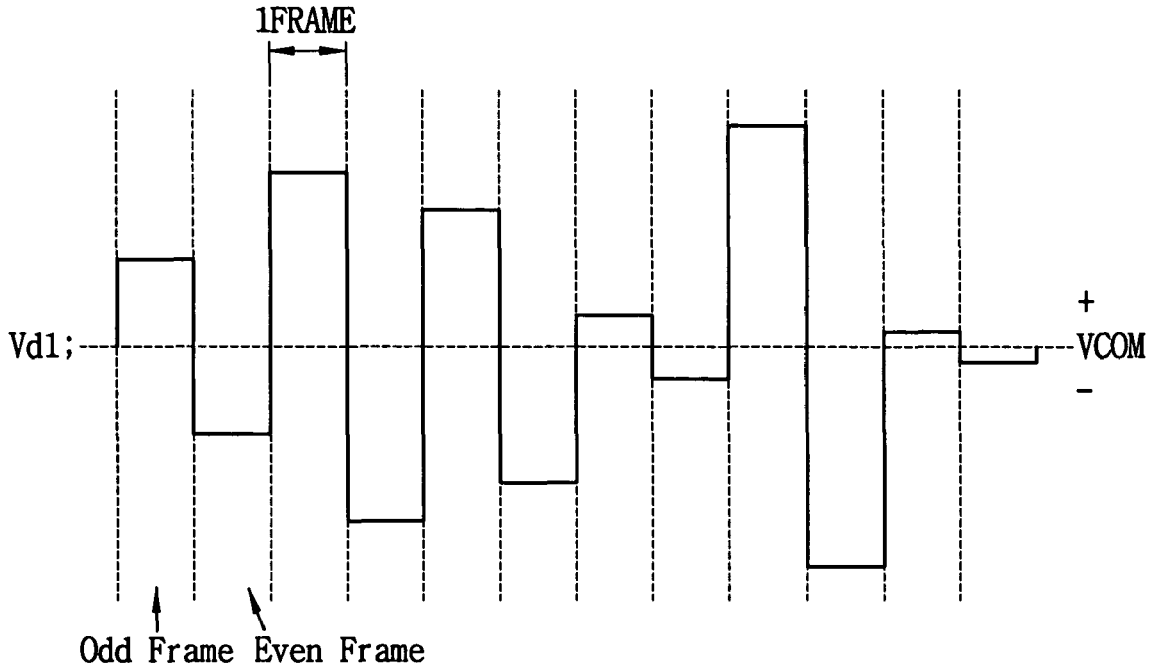
FIGS. 10A and 10B are timing diagrams showing another first data signal and another second data signal applied to the OELD shown in FIG. 8.
Figure 10B:
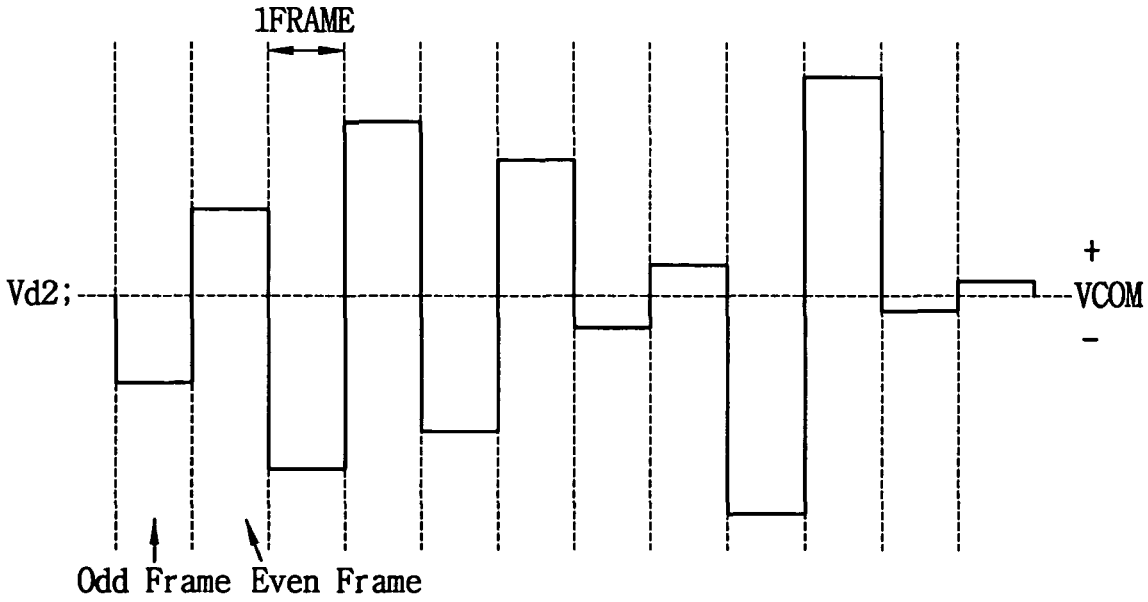

FIGS. 10A and 10B are timing diagrams showing another first data signal (Vd1) and another second data signal (Vd2) applied to the OELD shown in FIG. 8. It is to be understood that a gate voltage having a positive polarity and a gate voltage having a negative polarity are successively applied to the OELD.

Referring to FIGS. 10A and 10B, the first data signal Vd1 having a predetermined polarity and the second data signal Vd2 having a reverse polarity are applied to a second gate electrode of the first driving transistor QD1 and a fourth gate electrode of the second driving transistor QD2 during an odd frame, respectively. The predetermined polarity may be a positive polarity, and the reverse polarity may be a negative polarity. The first data signal Vd1 is applied to the second gate electrode to display an image, and the second signal Vd2 is applied to the fourth gate electrode to improve the characteristics of the second driving transistor QD2. The amount of the second data signal Vd2 having the negative polarity is similar to that of the first data signal Vd1 with respect to a common voltage (VCOM).

The first data signal Vd1 having a reverse polarity and the second data signal Vd2 having a predetermined polarity are applied to a second gate electrode of a first driving transistor QD1 and a fourth gate electrode of the second driving transistor QD2 during an even frame, respectively. The predetermined polarity may be a positive polarity, and the reverse polarity may be a negative polarity. The first data signal Vd1 is applied to the second gate electrode to improve the characteristics of the second driving transistor QD2, and the second signal Vd2 is applied to the fourth gate electrode to display an image. The amount of the second data signal Vd2 having the negative polarity is similar to that of the first data signal Vd1 with respect to a common voltage (VCOM).

Figure 11:
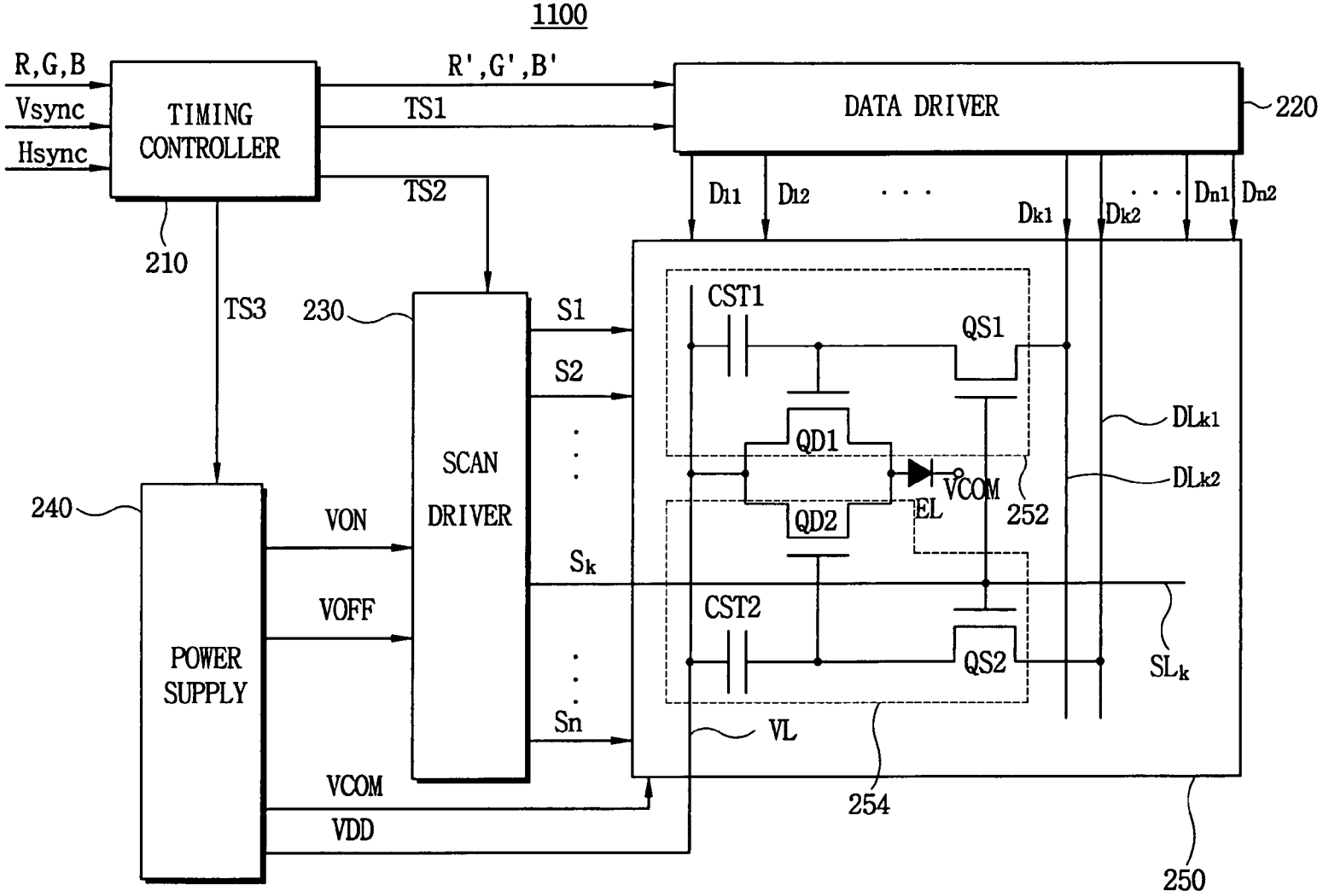
FIG. 11 is a schematic diagram showing an OELD according to another exemplary embodiment of the present invention.

FIG. 11 is a schematic diagram showing an OELD 1100 according to another exemplary embodiment of the present invention. Referring to FIG. 11, the OELD 1100 includes a timing controller 210, a data driver 220, a scan driver 230, a power supply 240 and an OELD panel 250. The data driver 220 outputs a data signal in response to an image signal. The scan driver 230 outputs a scan signal in response to a timing signal. The power supply 240 supplies a plurality of power voltages. The OELD panel 250 controls a current in response to the scan signal and the data signal to display an image using an organic electro luminescent element (EL).

An external graphic controller (not shown) applies first image signals (R, G, B) and control signals (Vsync, Hsync), which control the output of the first image signals R, G, B from the timing controller 210, which generates a first timing signal and a second timing signal (TS1 and TS2) and outputs the first timing signal TS1 and second image signals (R', G', B') to the data driver 220. The timing controller 210 also outputs a third timing signal (TS3) to the power supply 240.

The data driver 220 receives the second image signals R', G', B' and the first timing signal TS1 to output first data signals D11, D21 . . . Dk1 . . . Dn1 and second data signals D12, D22 . . . Dk2 . . . Dn2 to the OELD panel 250. The first data signals D1, D21 . . . Dk1 . . . Dn1 include a voltage having a positive polarity corresponding to gray-scales during an odd frame to display an image, and a voltage having a negative polarity to improve the characteristics of the first driving transistor QS1.

The first data signal (e.g., Dk1) having the positive polarity is applied from a first source electrode of the first switching transistor QS1 to a second gate electrode of the first driving transistor QD1 to display an image during an odd frame. The first data signal Dk1 having the negative polarity is applied from a first source electrode of the first switching transistor QS1 to a second gate electrode of the first driving transistor QD1 to improve the characteristics of the first driving transistor QD1 during the odd frame.

The second data signals D12, D22 . . . Dk2 . . . Dn2 include a voltage having a negative polarity during the odd frame to improve the characteristics of the second driving transistor QS2, and a voltage having a positive polarity corresponding to a gray-scale to display an image.

The second data signal (e.g., Dk2) having the negative polarity is applied from a third source electrode of the second switching transistor QS2 to a fourth gate electrode of the second driving transistor QD2 to improve the characteristics of the second driving transistor QS2 during the odd frame. The second data signal Dk2 having the positive polarity is applied from a third source electrode of the second switching transistor QS2 to a fourth gate electrode of the second driving transistor QD2 to display the image during the odd frame.

As shown in FIG. 11, the scan driver 230 receives the second timing signal TS2 to output a plurality of scan signals (S1, S2 . . . Sk. . . Sn) to the OELD panel 250. The power supply 240 receives the third timing signal TS3 to output a gate on/off and/or a voltage (VON/VOFF) signal to the scan driver 230. The power supply 240 also applies a common voltage (VCOM) and a bias voltage (VDD) to the OELD panel 250.

The OELD panel 250 includes a plurality of first data lines (DL1), a plurality of second data lines (DL2), a plurality of bias lines (VL), a plurality of scan lines (SL), a first organic electro luminescent driver 252, a second organic electro luminescent driver 254 and an organic electro luminescent element (EL). The first organic electro luminescent driver 252 is formed in a region defined by the first data lines DL1, the bias lines VL and the scan lines SL, which are located adjacent to each other, and includes a first a-Si TFT. The second organic electro luminescent driver 254 is formed in a region defined by the second data lines DL2, the bias lines VL and the scan lines SL adjacent to each other, and includes a second a-Si TFT. The organic electro luminescent element EL is electrically connected to the first and second organic electro luminescent drivers 252 and 254.

The first data lines DL1 are extended in a vertical direction, and arranged in a horizontal direction. The data driver 220 applies the first data signals D11, D21 . . . Dk1 . . . Dn1 to the first organic electro luminescent driver 252 through the first data lines DL1.

The second data lines DL2 are extended in the vertical direction, and arranged in the horizontal direction. The data driver 220 applies the second data signals D12, D22 . . . Dk2 . . . Dn2 to the second organic electro luminescent driver 254 through the second data lines DL2.

The bias lines VL are extended in the vertical direction, and arranged in the horizontal direction. The power supply 240 applies the bias voltage VDD to the first and second organic electro luminescent drivers 252 and 254 through the bias lines VL.

The scan lines SL are extended in the horizontal direction, and arranged in the vertical direction. The scan driver 230 applies the scan signals to the first and second organic electro luminescent drivers 252 and 254 through the scan lines SL.

In an alternative embodiment, the OELD 1100 may further include a common voltage line that applies the common voltage VCOM directly to the first and second organic electro luminescent elements EL. In this alternative embodiment, the power supply 240 applies the common voltage VCOM to the OELD panel 250 through the common voltage line.

As further shown in FIG. 11, the first organic electro luminescent driver 252 includes a first switching transistor (QS1), a first driving transistor (QD1) and a first storage capacitor (CST1). The second organic electro luminescent driver 254 includes a second switching transistor (QS2), a second driving transistor (QD2) and a second storage capacitor (CST2).

When current is controlled using the four transistors QS1, QS2, QD1 and QD2, the transistors QS1, QS2, QD1 and 0D2 may be formed in one layer or a plurality of layers stacked on top of each other. When the organic electro luminescent drivers 252 and 254 include the driving and switching transistors, a voltage applied to each of the transistors QS1, QS2, QD1 and QD2 is decreased to improve the characteristics of the transistors QS1, QS2, QD1 and QD2, thereby increasing the lifetime of the transistors QS1, QS2, QD1 and QD2.

Figure 12A:
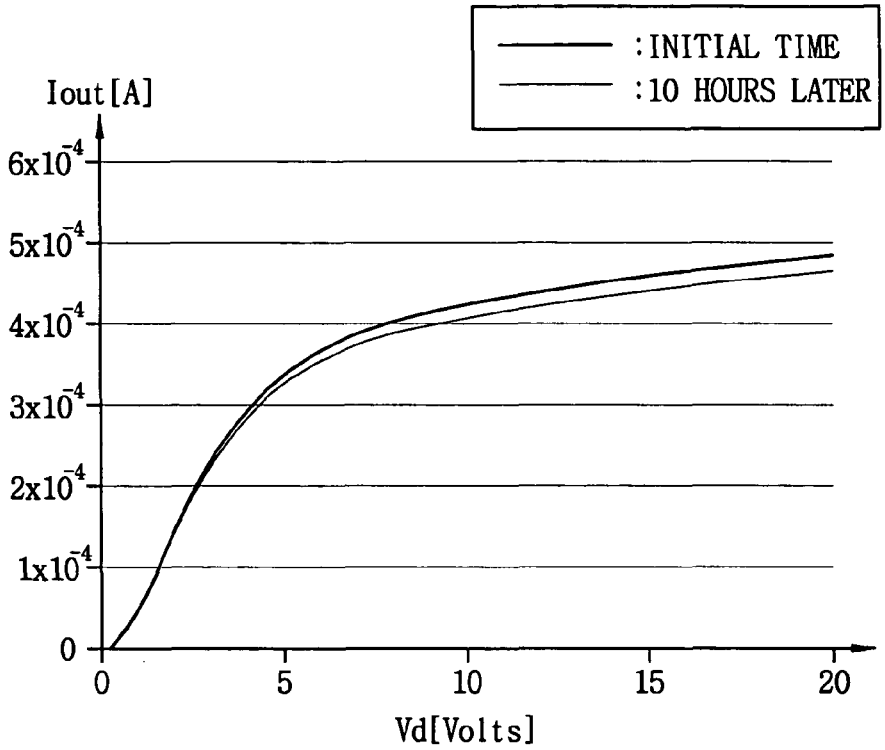
FIGS. 12A and 12B are graphs showing relationships between output currents and data voltages.
Figure 12B:
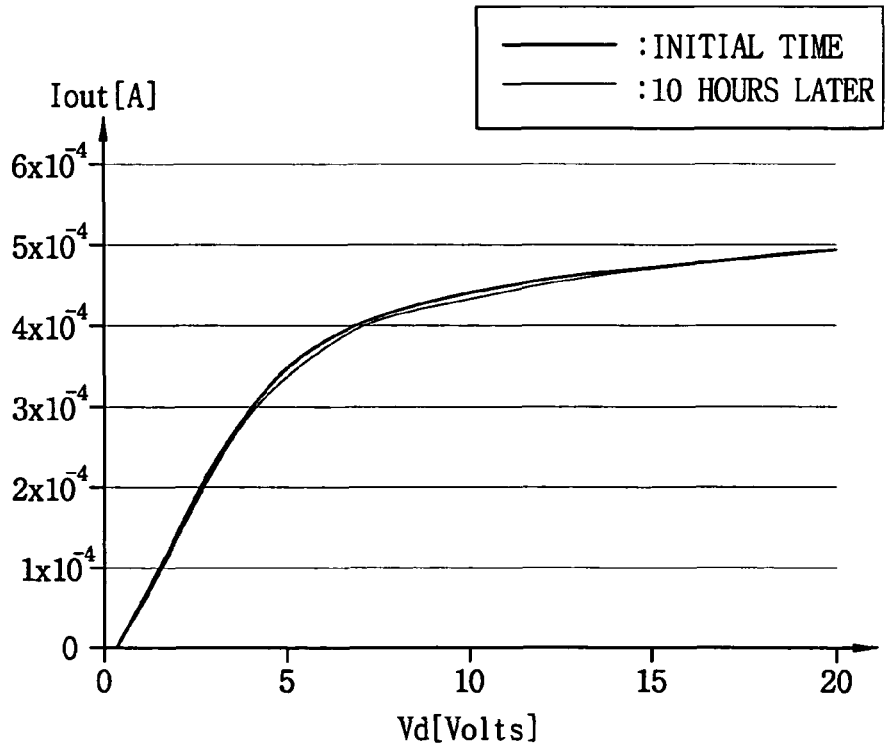

FIGS. 12A and 12B are graphs showing relationships between output currents (Iout) and data voltages (Vd). The channel width of a transistor used to illustrate the relationships between the output currents Iout and the data voltages Vd was 200 μm, and the channel length of the transistor was 3.5 μm. The gate voltage of the transistor was 8V, and the drain voltage of the transistor was 15V. The output current of the transistor was 45 μA.

FIG. 12A shows the relationship between the output current Iout and the data voltage Vd, when a gate voltage having a positive polarity is applied to a gate electrode of the transistor having the characteristics described above for 10 hours. Referring to FIG. 12A, when a voltage having a positive polarity was applied to the gate electrode, the current formed by the voltage having the positive polarity was not less than 4.59 μA at an initial time. The current, however, was not more than 4.40 μA. Thus, the output current was reduced by 4%.

FIG. 12B shows the relationship between the output current Iout and the data voltage Vd, when a gate voltage having a positive polarity and a reverse polarity is applied to the gate electrode of the transistor for 10 hours. The gate voltage corresponding to the reverse polarity was applied for 10 seconds every hour and was −10V. Referring to FIG. 12B, when the voltage having the negative polarity was applied is to the gate electrode intermittently, the difference between the output current Iout at the initial time and the output current Iout after 10 hours was negligible.

As shown by FIGS. 12A and 12B, when a data voltage Vd is applied to the transistor (e.g., a driving transistor), the degree of deterioration is dependent on the method used when applying the data voltage Vd. Thus, by applying the voltage having the reverse polarity to the driving transistor, the lifetime of the transistor increases.

Figure 13:
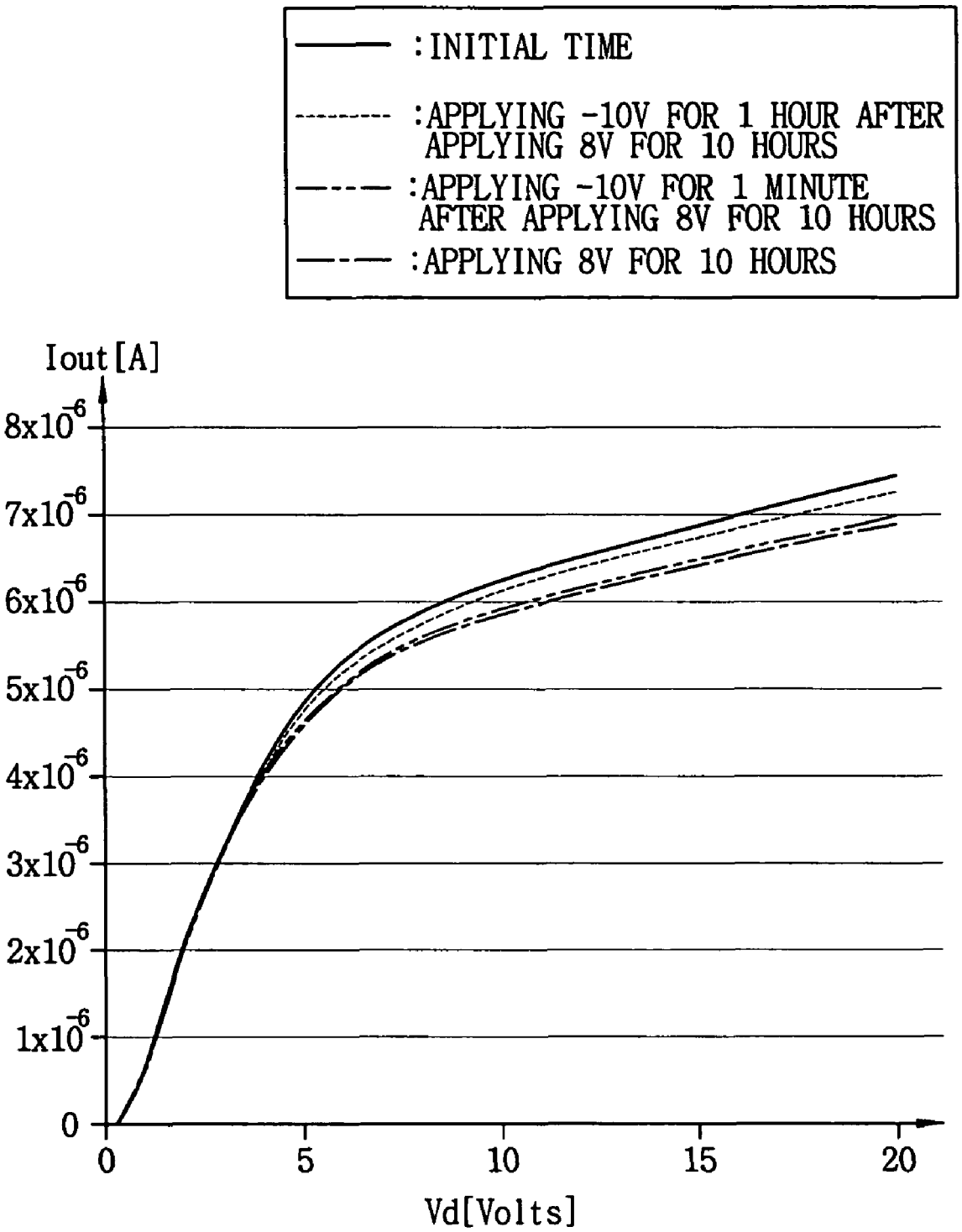
FIG. 13 is a graph showing a relationship between an output current and a data voltage having a negative polarity.

FIG. 13 is a graph showing a relationship between an output current (Iout) and a data voltage (Vd) having a negative polarity. Referring to FIG. 13, the output current Iout was decreased after a gate voltage of −8V was applied to the transistor for 10 hours. When a voltage having the negative polarity was applied for 60 seconds or 1 hour after the gate voltage of 8V was applied to the transistor for 10 hours, the output current Iout increased. Thus, the voltage having the reverse polarity (e.g., negative polarity) was applied to the transistor during/after operation to improve the characteristics of the transistor. According to the present invention, when a voltage having a predetermined polarity (e.g., a positive polarity) and an opposite polarity (e.g., negative polarity) is applied to a gate electrode of a TFT, the characteristics of the TFT improve.

While the present invention has been particularly shown and described with reference to exemplary embodiments thereof, it will be understood by those of ordinary skill in the art that various changes in form and details may be made therein without departing from the spirit and scope of the present invention as defined by the following claims and their equivalents.

What is claimed is:

1. A method for driving a transistor, comprising:

receiving a bias voltage at a first electrode of a driving transistor;

outputting a first signal having a positive polarity from a first electrode of a switching transistor to a capacitor and a control electrode of the driving transistor when a select line is activated for driving an organic display element during an image display period; and outputting a second signal having a negative polarity from the first electrode of the switching transistor to the capacitor and the control electrode of the driving transistor when the select line is activated for dissipating a charge in the driving transistor and for deactivating the organic display element during a non-image display period, wherein the first signal has different positive voltage levels in each image display period and a maximum voltage level of the first signal has a magnitude the same as a voltage level of the second signal.

2. The method of claim 1, wherein the second signal is output during the non-image display period in one of a single frame after the first signal is output and after multiple image display frames.

3. The method of claim 1, wherein the bias voltage is received at the first electrode of the driving transistor from a bias line.

4. The method of claim 1, wherein the first and second signals are received at a second electrode of the switching transistor from a data line.

5. The method of claim 1, wherein the switching transistor is one of an amorphous silicon thin film transistor (TFT) and a polysilicon TFT and the driving transistor is one of an amorphous silicon TFT and a polysilicon TFT.

6. The method of claim 1, wherein the driving transistor controls the bias voltage in response to the first signal for illuminating the organic display element.

7. A method for driving a transistor, comprising:

receiving a bias voltage at a first electrode of a driving transistor;

outputting a first signal having a positive polarity from a first electrode of a switching transistor to a capacitor and a control electrode of the driving transistor when a select line is activated for driving an organic display element during an initial time of each of a plurality of frames; and outputting a second signal having a negative polarity from the first electrode of the switching transistor to the capacitor and the control electrode of the driving transistor when the select line is activated for dissipating a charge in the driving transistor and for deactivating the organic display element during a remaining time of each of the plurality of frames, wherein the first signal has different positive voltage levels in each of the frames, the initial times of the frames correspond to an image display period, and the remaining times of the frames correspond to a non-image display period, and wherein a maximum voltage level of the first signal has a magnitude the same as a voltage level of the second signal.

* * * * *